US011022405B2

(12) United States Patent
Alter

(10) Patent No.: US 11,022,405 B2
(45) Date of Patent: Jun. 1, 2021

(54) BULLET-PROOF BACKPACK

(71) Applicant: David Alter, Apopka, FL (US)

(72) Inventor: David Alter, Apopka, FL (US)

( * ) Notice: Subject to any disclaimer, the term of this patent is extended or adjusted under 35 U.S.C. 154(b) by 0 days.

(21) Appl. No.: 16/600,804

(22) Filed: Oct. 14, 2019

(65) Prior Publication Data

US 2021/0108893 A1 Apr. 15, 2021

(51) Int. Cl.

| | |
|---|---|
| ***F41H 5/013*** | (2006.01) |
| ***A45F 4/02*** | (2006.01) |
| *F41H 1/02* | (2006.01) |
| *A45F 3/04* | (2006.01) |

(52) U.S. Cl.

CPC ..... *F41H 5/013* (2013.01); *A45F 4/02* (2013.01); *A45F 3/04* (2013.01); *F41H 1/02* (2013.01)

(58) Field of Classification Search

CPC ..... A45F 3/04; A45F 3/06; A45F 4/02; F41H 1/00; F41H 1/02; F41H 5/013; F41H 5/08

USPC ..... 89/36.02, 36.05; 2/2.5

See application file for complete search history.

(56) References Cited

U.S. PATENT DOCUMENTS

| | | | | |
|---|---|---|---|---|
| 3,762,345 | A * | 10/1973 | Sgariglia, Jr. | A45C 3/02 109/22 |
| 5,060,314 | A * | 10/1991 | Lewis | F41H 1/02 2/2.5 |
| 5,946,729 | A * | 9/1999 | Sakurai | A42B 1/08 2/202 |
| 6,161,738 | A * | 12/2000 | Norris | A45C 9/00 109/49.5 |
| 6,419,132 | B1 * | 7/2002 | Reed | A45C 15/00 109/49.5 |
| 6,685,071 | B2 * | 2/2004 | Prather | A45C 15/00 2/2.5 |
| 9,044,074 | B1 * | 6/2015 | De Freitas | F41H 1/02 |
| 9,801,452 | B2 * | 10/2017 | Duthoit | F41H 1/02 |
| 9,820,558 | B1 * | 11/2017 | de Geus | A45F 3/04 |
| 9,999,290 | B2 * | 6/2018 | Klein | A45F 3/08 |
| D828,016 | S | 9/2018 | Gillespie et al. | |
| 10,064,476 | B2 | 9/2018 | Vierthaler | |
| 10,130,160 | B1 * | 11/2018 | Cheng | A45F 3/06 |
| 10,188,197 | B2 | 1/2019 | Fraile Nuez | |
| 10,213,008 | B2 * | 2/2019 | Weaver, Jr. | A45F 3/06 |
| D843,714 | S | 3/2019 | Sheikh | |
| 10,299,570 | B2 | 5/2019 | Kim et al. | |
| 10,306,971 | B2 | 6/2019 | Zhang | |
| 10,321,750 | B2 | 6/2019 | Solomon et al. | |
| 10,342,320 | B2 | 7/2019 | Wang | |

(Continued)

*Primary Examiner* — Stephen Johnson
*Assistant Examiner* — Benjamin S Gomberg
(74) *Attorney, Agent, or Firm* — Heslin Rothenberg Farley & Mesiti P.C.

(57) ABSTRACT

A bullet-proof backpack includes a back protection section having bullet-proof material integrated therein. The back protection section is sized to cover a portion of a user's upper back when the backpack is worn by the user. The bullet-proof backpack also includes a neck protection section having bullet-proof material integrated therein. The neck protection section is movably connected to the backpack and operable to move from a stored position to a deployed position. When the neck protection section is in its stored position, it is stored against a portion of the backpack. When the neck protection section is in its deployed position, it covers a back of the user's neck and a back portion of the user's head when the backpack is worn by the user.

14 Claims, 6 Drawing Sheets

(56) References Cited

U.S. PATENT DOCUMENTS

| | | | | |
|---|---|---|---|---|
| 2019/0154405 | A1* | 5/2019 | Burnau | F41H 5/08 |
| 2020/0263959 | A1* | 8/2020 | Dieffenbach | F41H 1/02 |

* cited by examiner

BULLET-PROOF BACKPACK

TECHNICAL FIELD

The present disclosure relates to backpacks. More specifically, the disclosure relates to bullet-proof backpacks that protect the head and neck.

BACKGROUND

Gun fire in schools, universities, entertainment districts and other public places has become all too commonplace. If an active shooter enters a public place, people must take immediate measures to protect themselves. Bullet-proof vests may provide protection, but most people do not wear bullet-proof vests to public areas such as schools or entertainment districts. Moreover, bullet-proof vests may not protect the head and neck of a user.

Bullet-proof backpacks may be more convenient in that they may also be used to carry objects and belongings like books, papers and supplies. Moreover, such bullet-proof backpacks are often brought to schools, universities and public events.

However prior art bullet-proof backpacks may not protect the neck and head of a user. Additionally, bullet-proof backpacks may not protect the left and right shoulders of a user. Moreover, bullet-proof backpacks may not protect the pelvic region of a user. Further, neither the bullet proof backpack nor the bullet proof vest may protect the entire body of a user.

Accordingly, there is a need for a bullet-proof backpack that can protect at least a portion of the head and neck of a user. There is also a need for a bullet-proof backpack that can protect the left and right shoulders of a user. Further there is a need for a bullet-proof backpack that can protect the pelvic region of a user. Moreover, there is a need for a bullet-proof backpack that can protect the entire body of a user.

BRIEF DESCRIPTION

The present disclosure offers advantages and alternatives over the prior art by providing a bullet-proof backpack that protects at least the back of a user's neck and a back portion of the user's head from gun fire. In certain embodiments, the backpack may also protect the entire head of a user from gun fire. The backpack may also protect the left and right shoulders and pelvic region of a user. When worn on the back of a user, the bullet-proof backpack may include sections that are movable from a stored position to a deployed positon, which enable the backpack to protect larger regions of a user's body. When the movable sections of the bullet-proof backpack are in the deployed position and a user is in a seated position, the bullet-proof backpack may act as a full body shield.

A bullet-proof backpack in accordance with one or more aspects of the present disclosure includes a back protection section having bullet-proof material integrated therein. The back protection section is sized to cover a portion of a user's upper back when the backpack is worn by the user. The bullet-proof backpack also includes a neck protection section having bullet-proof material integrated therein. The neck protection section is movably connected to the backpack and operable to move from a stored position to a deployed position. When the neck protection section is in its stored position, it is stored against a portion of the backpack. When the neck protection section is in its deployed position, it covers a back of the user's neck and a back portion of the user's head when the backpack is worn by the user.

Another bullet-proof backpack in accordance with one or more aspects of the present disclosure includes a back protection section and a neck protection section. The back protection includes a backpack portion and a back protection panel. The backpack portion has storage compartments for carrying items of interest to the user. The back protection panel is disposed between the backpack portion and the user's upper back when the backpack is worn by the user. The back protection panel has bullet-proof material integrated therein. The back protection panel is sized to cover a portion of a user's upper back when the backpack is worn by the user. The neck protection panel of the bullet-proof backpack also has bullet-proof material integrated therein. The neck protection panel is movably connected to the backpack and is operable to move from a stored position to a deployed position. When the neck protection panel is in its stored position, it is stored against a portion of the backpack. When the neck protection panel is in its deployed position, it extends upward from the backpack to cover a back of the user's neck and a back portion of the user's head when the backpack is worn by the user.

DRAWINGS

The disclosure will be more fully understood from the following detailed description taken in conjunction with the accompanying drawings, in which.

DETAILED DESCRIPTION

Certain examples will now be described to provide an overall understanding of the principles of the structure, function, manufacture, and use of the methods, systems, and devices disclosed herein. One or more examples are illustrated in the accompanying drawings. Those skilled in the art will understand that the methods, systems, and devices specifically described herein and illustrated in the accompanying drawings are non-limiting examples and that the scope of the present disclosure is defined solely by the claims. The features illustrated or described in connection with one example maybe combined with the features of other examples. Such modifications and variations are intended to be included within the scope of the present disclosure.

The terms "substantially", "approximately", "about", "relatively," or other such similar terms that may be used throughout this disclosure, including the claims, are used to describe and account for small fluctuations, such as due to variations in processing from a reference or parameter. Such small fluctuations include a zero fluctuation from the reference or parameter as well. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Figure 2:
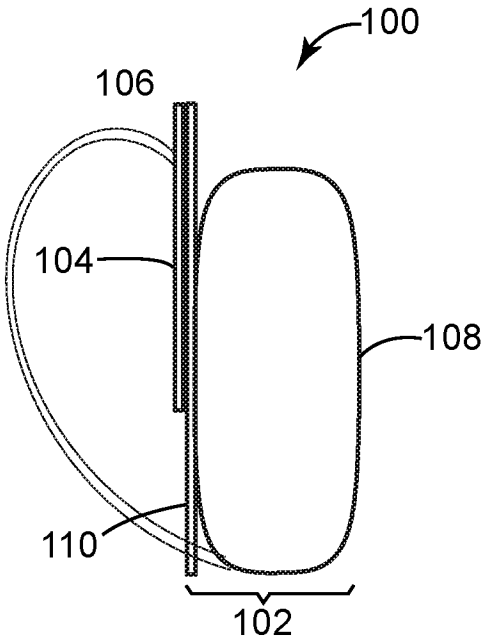
FIG. 2 depicts a side view of an example of the bullet proof backpack of FIG. 1, according to aspects described herein.
Figure 1:
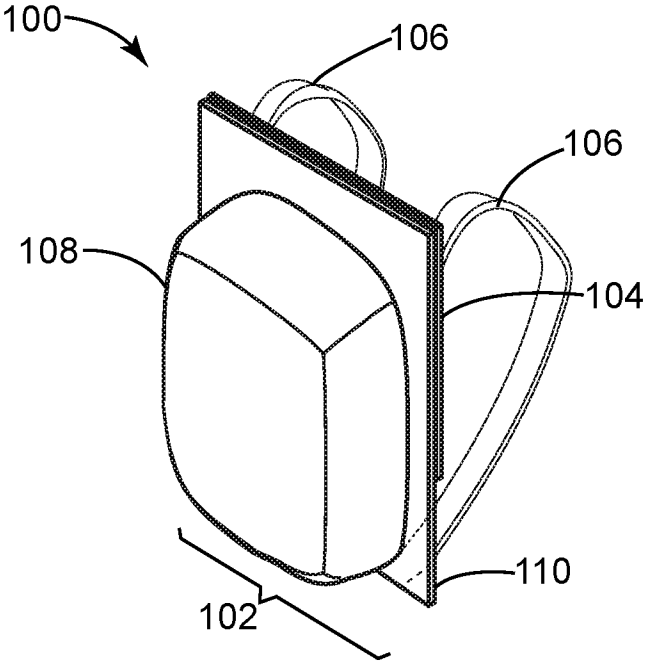
FIG. 1 depicts a rear perspective view of an example of a bullet proof backpack, having a back protection section and a neck protection section wherein the neck protection section is in a stored position, according to aspects described herein.

Referring to FIGS. 1 and 2, a rear perspective view (FIG. 1) and a side view (FIG. 2) of an example of a bullet proof backpack 100 is depicted, in accordance with aspects described herein. The backpack 100 has a back protection section 102 and a neck protection section 104.

Figure 7B:
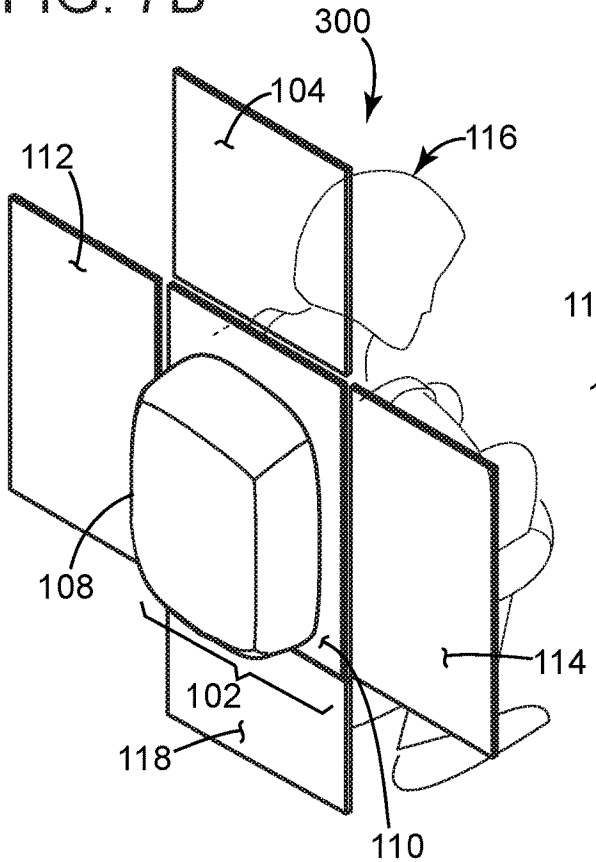
FIG. 7B depicts a rear perspective view of the example of the bullet proof backpack of FIG. 7A, wherein the user is wearing the backpack in a sitting position, according to aspects described herein.
Figure 7A:
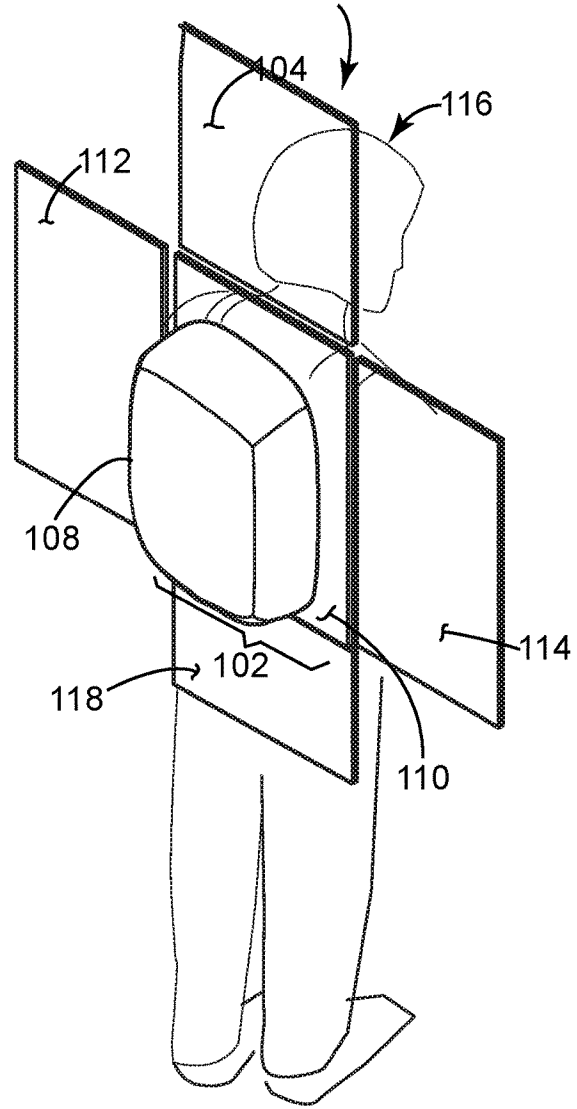
FIG. 7A depicts a rear perspective view of the example of the bullet proof backpack of FIG. 5, having a pelvic protection section, wherein the pelvic protection section is in a deployed position, and wherein a user is wearing the backpack in a standing position, according to aspects described herein.

A pair of adjustable backpack straps 106 are also attached to the backpack 100 and sized to fit over the shoulders of a user 116 (see FIG. 7A). The backpack straps are operable to position and securely hold the backpack 100 to the user's back.

The back protection section 102 includes a backpack portion 108 and a back protection panel 110. The backpack portion 108 includes one or more storage compartments (not shown) for carrying items of interest to the user 116.

The back protection panel 110 is disposed between the backpack portion 108 and the user's upper back (see FIG. 7A) when the backpack 100 is worn by the user 116. The back protection panel 110 in this example has bullet-proof material integrated therein and is sized to cover a portion of a user's upper back when the backpack 100 is worn by the user 116.

More than one configuration of the back protection panel 110 is within the scope of this invention. For example, the back protection panel 110 may be a solid panel or may be a flexible fabric that is secured to a framed border.

The bullet proof material may be any appropriate material used to deter the penetration of different types of bullets. For example, the bullet proof material may be fibers composed of one or more combinations of nylon, polyethylene or aramid. The bullet proof material may also be composed of brand name fabrics such as, for example, Kevlar®, Spectra®, Twaron®, or Dyneena®. The bullet proof material may also be composed of carbon nanotubes or multiple layers of graphene sheets. The bullet proof material may be any combination of bullet proof materials listed herein and any other appropriate material depending on design parameters.

Though the example illustrated in FIGS. 1 and 2 describes the back protection panel 110 of the back protection section 102 as having bullet proof material, other configurations of the back protection section 102 are also within the scope of this invention. For example, the backpack portion 108 of the back protection section 102, may also include bullet proof materials. Further, the back protection section 102 may only include a bullet proof backpack portion 108 and may not have a back protection panel 110.

The neck protection section 104 of the bullet proof backpack 100 also has bullet-proof material integrated therein. In this example, the neck protection section 104 is illustrated as a neck protection panel 104 and will be referred to herein as the neck protection panel for purposes of clarity.

More than one configuration of the neck protection panel 104 is within the scope of this invention. For example, the neck protection panel 104 may be a solid panel or may be a flexible fabric that is secured to a framed border.

Figure 4:
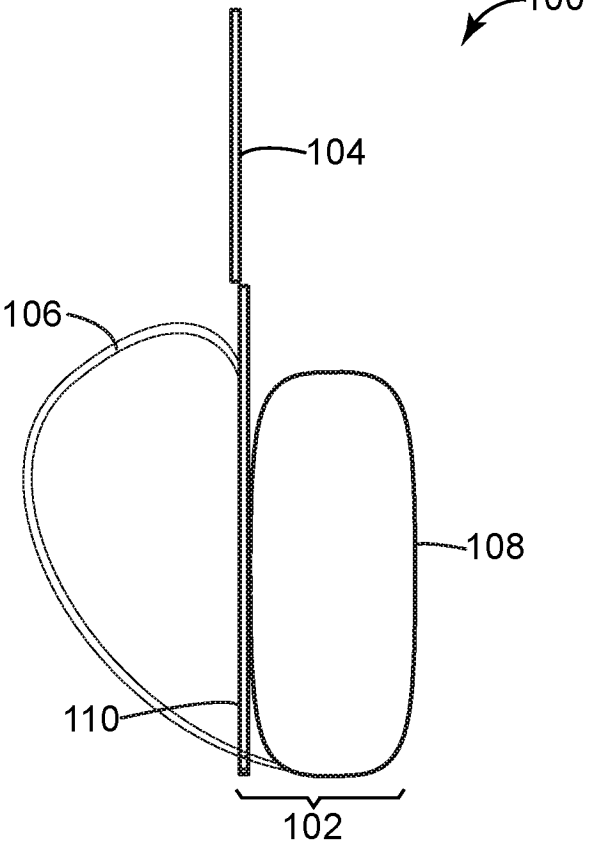
FIG. 4 depicts a side view of the example of the bullet proof backpack of FIG. 3, according to aspects described herein.
Figure 3:
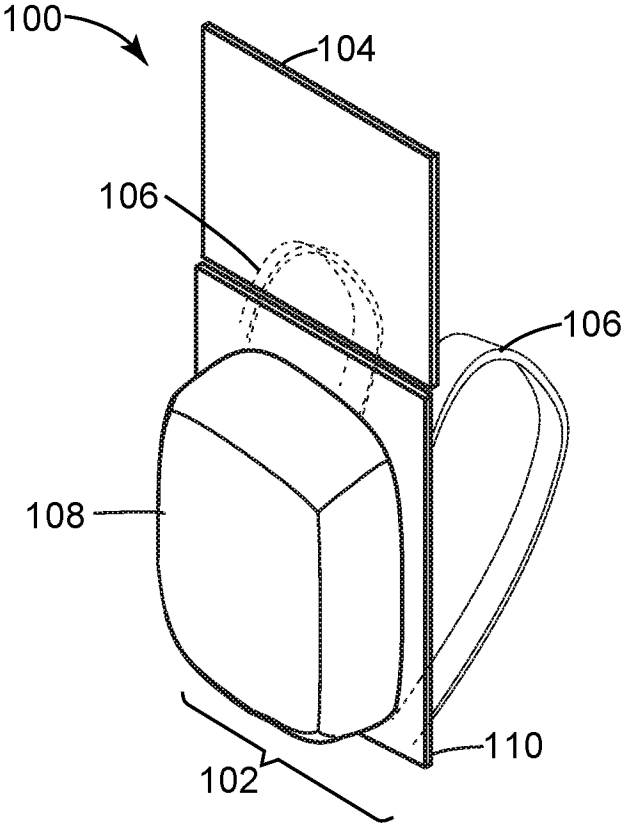
FIG. 3 depicts a rear perspective view of the example of the bullet proof backpack of FIG. 1, having the neck protection section in a deployed position, according to aspects described herein.

The neck protection panel 104 is movably connected to the backpack 100 and is operable to move from a stored position (as illustrated in FIGS. 1 and 2) to a deployed position (as illustrated in FIGS. 3 and 4).

When the neck protection panel 104 is in its stored position, it is stored against a portion of the backpack 100. In this specific example, the neck protection panel 104 is stored between the back protection panel 110 and a user's upper back when the backpack 100 is being worn by the user 116.

Referring to FIGS. 3 and 4, a rear perspective view (FIG. 3) and a side view (FIG. 4) of the example of the bullet proof backpack 100, having the neck protection panel 104 in a deployed position, is depicted according to aspects described herein. When the neck protection panel 104 is in its deployed position, it covers a back of the user's neck and a back portion of the user's head when the backpack 100 is worn by the user 116.

The neck protection panel 104 may be slidably connected to the backpack 100. More specifically, the neck protection panel 104 may be slidably connected to the back protection panel 110 through a spring system (not shown). The spring system may be operable to slidably extend the neck protection panel from the stored position to the deployed position.

Alternatively, the neck protection panel 104 may be pivotally connected to the backpack 100 via a joint system (not shown). The joint system may be operable to pivotally rotate the neck protection panel 104 from the stored position to the deployed position.

Though this example illustrates the neck protection section 104 as being a neck protection panel 104, other configurations of the neck protection section are within the scope of the present invention. For example, the neck protection section 104 may be a fabric hooded section sewn to the top of the backpack portion 108. The hooded portion may include bullet proof materials integrated therein. The hooded portion may be operable to be manually thrown over a user's head to protect the neck and head simultaneously.

Figure 6:
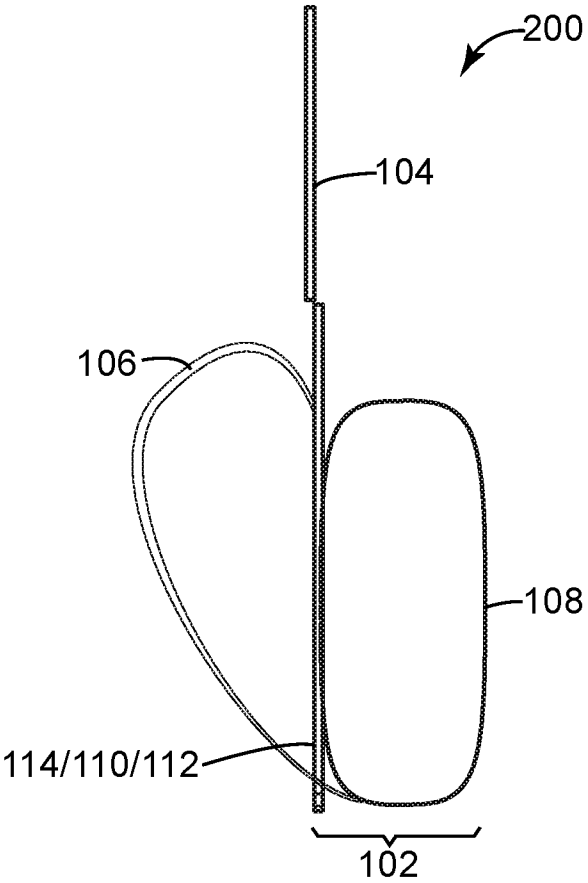
FIG. 6 depicts a side view of the example of the bullet proof backpack of FIG. 5, according to aspects described herein.
Figure 5:
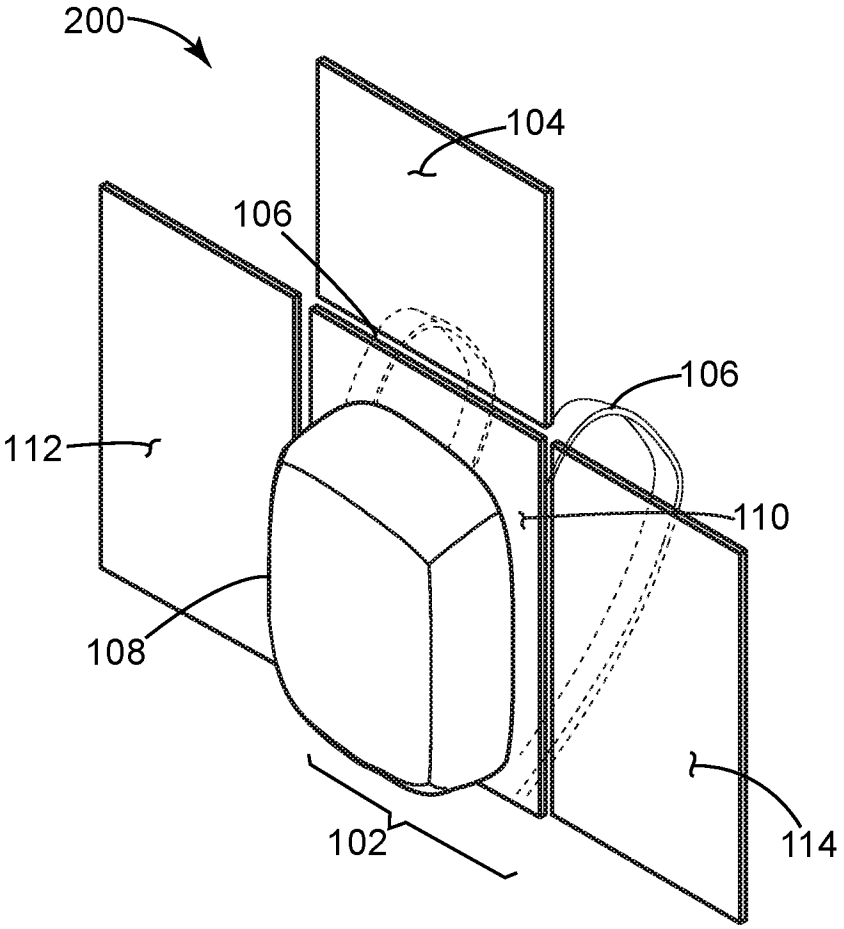
FIG. 5 depicts a rear perspective view of the example of the bullet proof backpack of FIG. 3, having a left side protection section and a right side protection section, wherein the left and right side protection sections are in a deployed position, according to aspects described herein.

Referring to FIGS. 5 and 6, a rear perspective view (FIG. 5) and a side view (FIG. 6) of another example of a bullet proof backpack 200 is depicted according to aspects described herein. In this example, the bullet proof backpack 200 includes the same or similar features discussed in FIGS. 1-4, wherein the same or similar features are labeled with the same reference numbers. Additionally the backpack 200 includes a left side protection section 112 and a right side protection section 114. The left and right side protection sections 112, 114 are illustrated in a deployed position in FIGS. 5 and 6.

In this specific example, the left and right side protection sections 112, 114 are illustrated as left and right side protection panels 112, 114. More than one configuration of the left and right side protection panels 112, 114 are within the scope of this invention. For example, the left and right side protection panels 112, 114 may be solid panels or may be composed of a flexible fabric that is secured to a framed border.

The left side protection panel 112 and the right side protection panel 114 each have bullet proof material integrated therein. The left and right side protection panels 112, 114 each are movably connected to the backpack 200 and each are operable to move from a stored position to a deployed position.

When the left and right side protection panels 112, 114 are in their stored positions, they are each stored against a portion of the backpack 200. For example, in much the same way that the neck protection panel 104 is stored, the left and right side protection panels 112, 114 may also be stored between the back protection panel 110 and a user's upper back when the backpack 200 is being worn by the user 116.

When the left side protection panel 112 is in its deployed position, it covers a portion the user's left side when the backpack is worn by the user 116. When the right side protection panel 114 is in its deployed position, it covers a portion the user's right side when the backpack is worn by the user 116.

More specifically, when the left side protection panel 112 is in its deployed position, it covers a portion of the user's left side and a back portion the user's left shoulder when the backpack 200 is worn by the user 116. When the right side protection panel 114 is in its deployed position, it covers a portion of the user's right side and a back portion the user's right shoulder when the backpack 200 is worn by the user 116.

When the left side protection panel 112 is in its deployed position, it extends horizontally leftward from the backpack 200 when the backpack 200 is worn by the user 116. When the right side protection panel 114 is in its deployed position, it extends horizontally rightward from the backpack 200 when the backpack 200 is worn by the user 116.

The left and right side protection panels 112, 114 may be slidably connected to the backpack 200. More specifically, the left and right side protection panels 112, 114 may be slidably connected to the back protection panel 110 through a spring system (not shown). The spring system may be operable to slidably extend the left and right side protection panels from the stored position to the deployed position.

Alternatively, the left and right side protection panels 112, 114 may be pivotally connected to the backpack 200 via a joint system (not shown). The joint system may be operable to pivotally rotate the left and right side protection panels 112, 114 from the stored position to the deployed position.

Though this example illustrates the left and right side protection sections 112, 114 as being left and right side protection panels 112, 114, other configurations of the left and right side protection sections are within the scope of the present invention. For example, the left and right side protection sections 112, 114 may each be a fabric side cover section sewn to the sides of the backpack portion 108. The fabric side cover sections may include bullet proof materials integrated therein. The fabric side cover sections 112, 114 may each be operable to be manually wrapped around a user's left and right sides respectively to protect the sides of a user 116 when in the deployed position. The fabric side cover sections 112, 114 may or may not cover the user's left and right shoulders.

Figure 8:
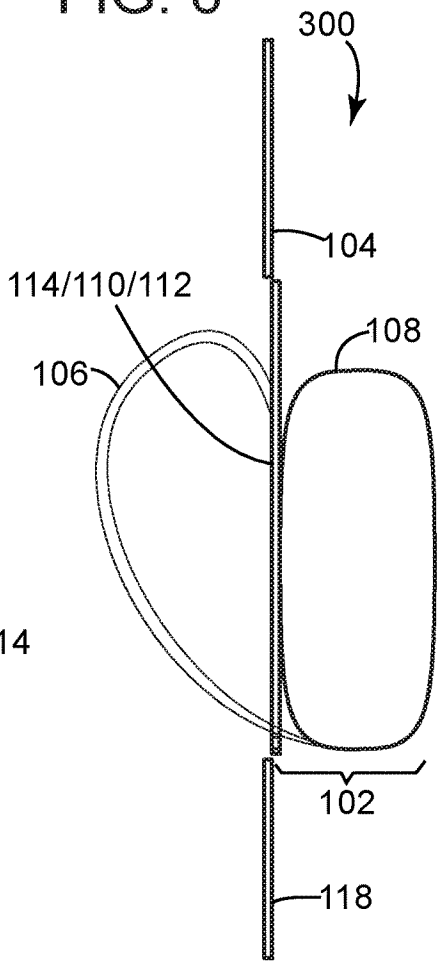
FIG. 8 depicts a side view of the example of the bullet proof backpack of FIG. 7A, according to aspects described herein.

Referring to FIGS. 7A, 7B and 8, a rear perspective view (FIGS. 7A and 7B) and a side view (FIG. 8) of another example of a bullet proof backpack 300 is depicted according to aspects described herein. In FIG. 7A, a user 116 is wearing the backpack 300, when in a standing position. In FIG. 7B, the user 116 is wearing the backpack 300, when in a sitting position. In this example, the bullet proof backpack 300 includes the same or similar features discussed in FIGS. 5-6, wherein the same or similar features are labeled with the same reference numbers. Additionally the backpack 300 includes a pelvic protection section 118. The pelvic protection section 118 is illustrated in a deployed position in FIGS. 7A, 7B and 8.

In this specific example, the pelvic protection section 118 is illustrated as a pelvic protection panel 118. More than one configuration of the pelvic protection panel 118 is within the scope of this invention. For example, the pelvic protection panel 118 may be a solid panel or may be composed of a flexible fabric that is secured to a framed border. The pelvic section 118 may also be composed of a flexible fabric with no framed border, such that is will bend or fold when a user is sitting down.

The pelvic protection panel 118 has bullet proof material integrated therein. The pelvic protection panel 118 is movably connected to the backpack 300 and is operable to move from a stored position to a deployed position.

When the pelvic protection panel 118 is in its stored position, it is stored against a portion of the backpack 300. For example, in much the same way that the neck protection panel 104 is stored, the pelvic protection panel 118 may also be stored between the back protection panel 110 and a user's upper back when the backpack 300 is being worn by the user 116.

When the pelvic protection panel 118 is in its deployed position, it covers a back portion the user's pelvic region when the backpack is worn by the user 116. When the pelvic protection panel 118 is in its deployed position, it extends vertically downward from the backpack 300 when the backpack 300 is worn by the user 116.

The pelvic protection panel 118 may be slidably connected to the backpack 300. More specifically, the pelvic protection panel 118 may be slidably connected to the back protection panel 110 through a spring system (not shown). The spring system may be operable to slidably extend the pelvic protection panel from the stored position to the deployed position.

Alternatively, the pelvic protection panel 118 may be pivotally connected to the backpack 300 via a joint system (not shown). The joint system may be operable to pivotally rotate the pelvic protection panel 118 from the stored position to the deployed position.

Though this example illustrates the pelvic protection section 118 as being a pelvic protection panel 118, other configurations of the pelvic protection section are within the scope of the present invention. For example, the pelvic protection section 118 may be a fabric back cover section sewn to the bottom of the backpack portion 108. The fabric back cover section may include bullet proof materials integrated therein. The fabric back cover section 118 may be operable to be manually pulled down over a user's pelvic region to protect the pelvic region of the user 116 when in the deployed position.

Referring more specifically to FIG. 7A, when the user is in the standing position, and all protection sections 104, 112, 114, and 118 are in their deployed positions, the backpack 300 covers most of the user's body, with only the user's legs being exposed. Referring more specifically to FIG. 7B, when the user is in the sitting position, and all protection sections 104, 112, 114, and 118 are in their deployed positions, the backpack 300 substantially covers the user's entire body, including the user's legs.

Figure 10:
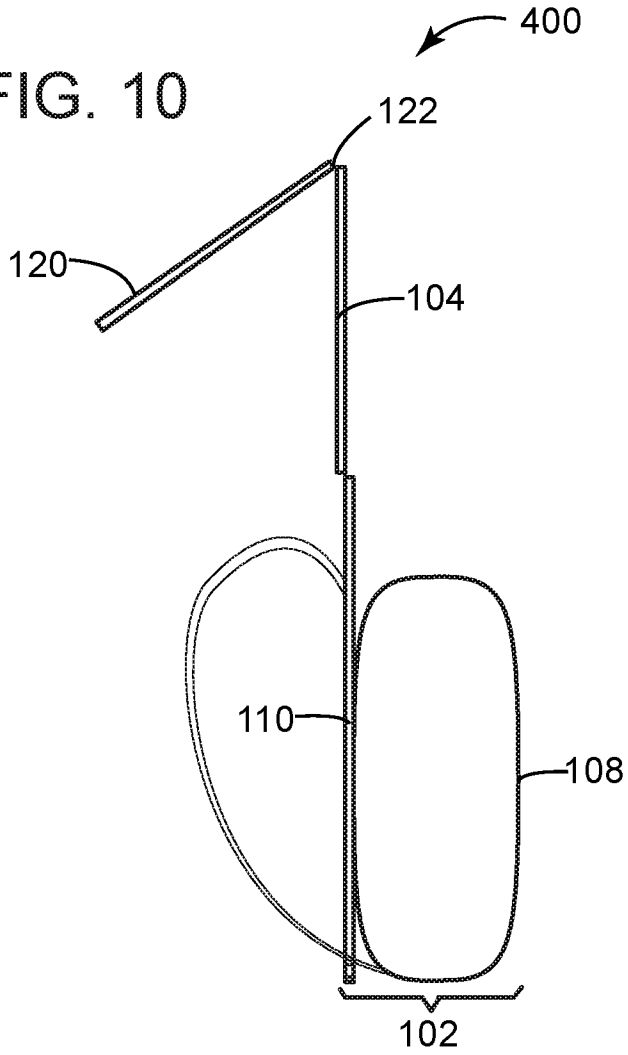
FIG. 10 depicts a side view of the example of the bullet proof backpack of FIG. 9, according to aspects described herein.
Figure 9:
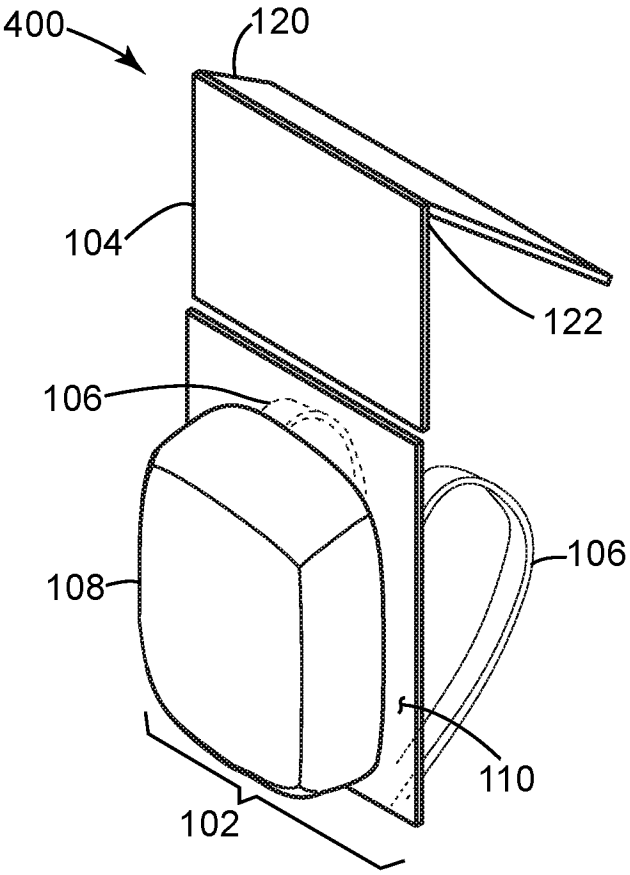
FIG. 9 depicts a rear perspective view of an example of the bullet proof backpack of FIG. 3, having a head protection section pivotally connected to an upper end of the neck protection section, and wherein the head protection section is in a deployed position, according to aspects described herein.

Referring to FIGS. 9 and 10, a rear perspective view (FIG. 9) and a side view (FIG. 10) of another example of a bullet proof backpack 400 is depicted according to aspects described herein. In this example, the bullet proof backpack 400 includes the same or similar features discussed in FIGS. 1-4, wherein the same or similar features are labeled with the same reference numbers. Additionally the backpack 400 includes a head protection section 120. The head protection section 120 is illustrated in a deployed position in FIGS. 9 and 10.

In this specific example, the head protection section 120 is illustrated as a head protection panel 120. More than one configuration of the head protection panel 120 is within the scope of this invention. For example, the head protection panel 120 may be a solid panel or may be composed of a flexible fabric that is secured to a framed border.

The head protection panel 120 has bullet proof material integrated therein. The head protection panel 120 is movably connected to the backpack 400 and is operable to move from a stored position to a deployed position.

When the head protection panel 120 is in its stored position, it is stored against a portion of the backpack 400. For example, the head protection panel 120 may be pivotally connected to an upper end of the neck protection panel 104 at a pivot joint 122. The pivot joint 122 may allow the head protection panel 120 to be folded flat against the neck protection panel 104 when the head protection panel 120 is in its stored position. The head protection panel 120 and neck protection panel 104 each in their stored positions, may be stored against a portion of the backpack 400. In this specific example, the head and neck protection panels 120, 104 may be stored between the back protection panel 110 and a user's upper back when the backpack 400 is being worn by the user 116.

When the head protection panel 120 is in its deployed position, it covers a top portion the user's head when the backpack 400 is worn by the user 116. When the head protection panel 120 is in its deployed position, it extends outwardly from the pivot joint 122 over the top portion of the user's head when the backpack 400 is worn by the user 116.

Though this example illustrates the head protection section 120 as being a head protection panel 120, other configurations of the head protection section are within the scope of the present invention. For example, the head protection section 120 may be a fabric helmet section sewn to the upper end of the neck protection panel 104. The fabric helmet section may include bullet proof materials integrated therein. The fabric helmet section 120 may be operable to be manually pulled down over a user's head to protect the head of the user 116 when in the deployed position.

Figure 12:
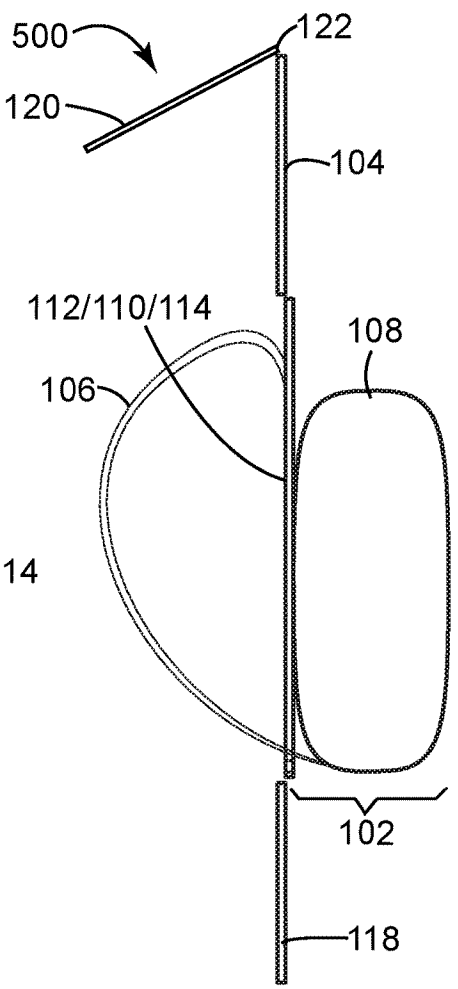
FIG. 12 depicts a side view of the example of the bullet proof backpack of FIG. 11A, according to aspects described herein.
Figure 11B:
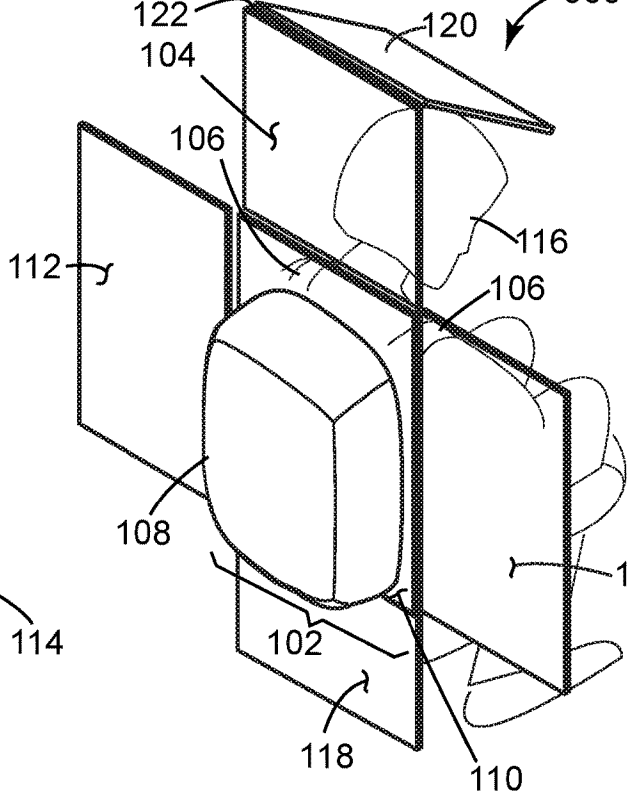
FIG. 11B depicts a rear perspective view of the example of the bullet proof backpack of FIG. 11A, wherein the user is wearing the backpack in a sitting position, according to aspects described herein.
Figure 11A:
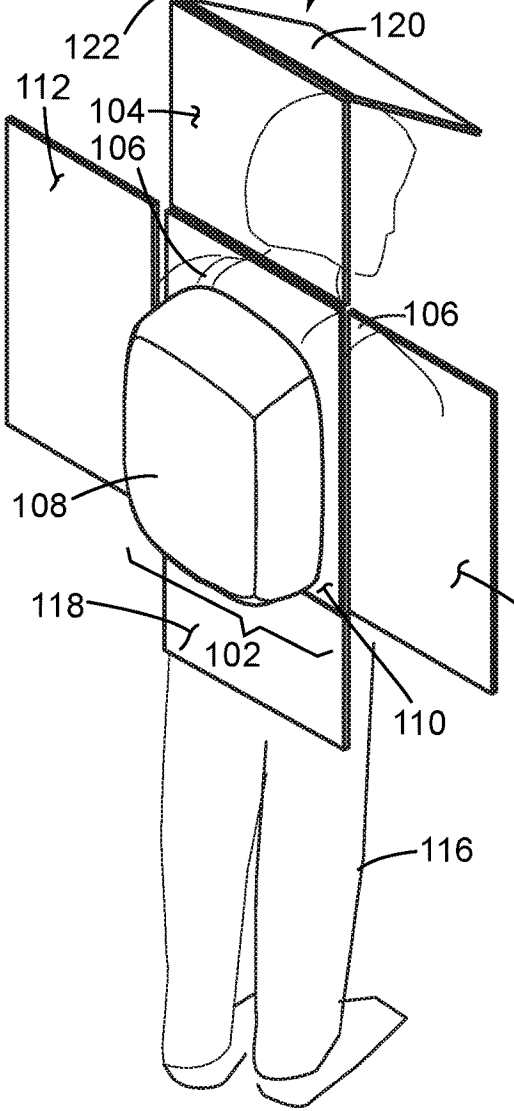
FIG. 11A depicts a rear perspective view of the example of the bullet proof backpack of FIG. 9, having a left side protection section, a right side protection section and a pelvic protection section, wherein the left side, right side and pelvic protection sections are in a deployed position, and wherein a user is wearing the backpack in a standing position, according to aspects described herein.

Referring to FIGS. 11A, 11B and 12, a rear perspective view (FIGS. 11A and 11B) and a side view (FIG. 12) of another example of a bullet proof backpack 500 is depicted according to aspects described herein. In FIG. 11A, a user 116 is wearing the backpack 500, when in a standing position. In FIG. 11B, the user 116 is wearing the backpack 500, when in a sitting position. In this example, the bullet proof backpack 500 includes the same or similar features discussed in FIGS. 7A, 7B and 8, wherein the same or similar features are labeled with the same reference numbers. Additionally the backpack 500 includes a head protection section 120. The head protection section 120 is illustrated in a deployed position in FIGS. 11A, 11B and 12.

In this specific example, the head protection section 120 of backpack 500 is illustrated as a head protection panel 120. More than one configuration of the head protection panel 120 is within the scope of this invention. For example, the head protection panel 120 may be a solid panel or may be composed of a flexible fabric that is secured to a framed border.

The head protection panel 120 has bullet proof material integrated therein. The head protection panel 120 is movably connected to the backpack 500 and is operable to move from a stored position to a deployed position.

More specifically, in the example illustrated in FIGS. 11A, 11B and 12, the bullet-proof backpack 500 includes the back protection section 102 and the neck protection section 104. The back protection section includes the backpack portion 108 and the back protection panel 110. The back protection panel 110 has bullet-proof material integrated therein.

The adjustable backpack straps 106 are also connected to the backpack 500. The backpack straps 106 are adjustable to fit over the shoulders of a user 116.

The neck protection section 104 of backpack 500 is configured as a neck protection panel 104. The neck protection panel 104 has bullet-proof material integrated therein. When the neck protection panel 104 is in its deployed position, it extends upwards from the backpack 500 to cover a back of the user's neck and a back portion of the user's head when the backpack 500 is worn by the user.

The backpack 500 also includes a head protection section 120 having bullet-proof material integrated therein. The head protection section 120 is configured as a head protection panel 120. The head protection panel 120 is pivotally connected to an upper end of the neck protection panel 104 at a pivot joint 122. When the head protection panel 120 is in its deployed position, it extends forward from the pivot joint 122 to cover the top portion of the user's head.

The backpack 500 also includes a left side protection panel 112 having bullet-proof material integrated therein. The left side protection panel 112 is movably connected to the backpack 500 and is operable to move from a stored position to a deployed position. When the left side protection panel 112 is in its stored position, it is stored against a portion of the backpack 500. When the left side protection panel 112 is in its deployed position, it covers a portion of the user's left side and a back portion of the user's left shoulder when the backpack 500 is worn by the user 116.

The backpack 500 also includes a right side protection panel 114 having bullet-proof material integrated therein. The right side protection panel 114 is movably connected to the backpack 500 and operable to move from a stored position to a deployed position. When the right side protection panel 114 is in its stored position, it is stored against a portion of the backpack 500. When the right side protection panel 114 is in its deployed position, it covers a portion of the user's right side and a back portion of the user's right shoulder when the backpack 500 is worn by the user 116.

The bullet proof backpack 500 also includes a pelvic protection panel 118 having bullet proof material integrated therein. The pelvic protection panel 118 is movably connected to the backpack 500 and operable to move from a stored position to a deployed position. When the pelvic protection panel 118 is in its stored position, it is stored against a portion of the backpack 500. When the pelvic protection section 118 is in its deployed position, it extends downwards from the back protection panel 110 to cover a back portion of the user's pelvic region when the backpack 500 is worn by the user 116.

Referring more specifically to FIG. 11A, when the user 116 is in the standing position, and all protection sections 104, 112, 114, 118 and 120 are in their deployed positions, the backpack 500 covers most of the user's body, with only the user's legs being exposed. Referring more specifically to FIG. 11B, when the user is in the sitting position, and all protection sections 104, 112, 114, 118 and 120 are in their deployed positions, the backpack 500 substantially covers the user's entire body, including the user's legs and the top portion of the user's head.

Though this example illustrates the pelvic protection section 118 as being a pelvic protection panel 118, other configurations of the pelvic protection section are within the scope of the present invention. For example, the pelvic protection section 118 may be a fabric back cover section sewn to the bottom of the backpack portion 108. The fabric back cover section may include bullet proof materials integrated therein. The fabric back cover section 118 may be operable to be manually pulled down over a user's pelvic region to protect the pelvic region of the user 116 when in the deployed position.

It should be appreciated that all combinations of the foregoing concepts and additional concepts discussed in greater detail herein (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

Although the invention has been described by reference to specific examples, it should be understood that numerous changes may be made within the spirit and scope of the inventive concepts described. Accordingly, it is intended that the disclosure not be limited to the described examples, but that it have the full scope defined by the language of the following claims.

What is claimed is:

1. A bulletproof backpack comprising:

a back protection section having bulletproof material integrated therein, the back protection section adapted to cover a portion of a user's upper back when the backpack is worn by the user;

a neck protection section having the bulletproof material integrated therein, the neck protection section movably connected to the back protection section and operable to move from a stored position to a deployed position of the neck protection section;

wherein, when the neck protection section is in the stored position of the neck protection section, the neck protection section is stored against the back protection section; and wherein, when the neck protection section is in the deployed position of the neck protection section, the neck protection section is connected solely to the back protection section and the neck protection section covers solely a back of the user's neck and a back portion of the user's head when the backpack is worn by the user;

wherein, the neck protection section is operable to be secured in the deployed position of the neck protection section without manually being held in the deployed position of the neck protection section.

2. The bulletproof backpack of claim 1, comprising:

the back protection section comprising:

a backpack portion, and a back protection panel disposed between the backpack portion and the portion of the user's upper back when the backpack is worn by the user, the back protection panel having the bulletproof material integrated therein; and the neck protection section comprising:

a neck protection panel having the bulletproof material integrated therein, the neck protection panel movably connected to the back protection section and operable to move from a stored position to a deployed position of the neck protection panel, and wherein, when the neck protection panel is in the deployed position of the neck protection panel, the neck protection panel extends upwards from the back protection section to cover the back of the user's neck and the back portion of the user's head when the backpack is worn by the user.

3. The bulletproof backpack of claim 1 comprising:

a left side protection section and a right side protection section each having the bulletproof material integrated therein, the left and right side protection sections each being movably connected to the back protection section, and each being operable to move from a stored position to a deployed position of the left and right side protection sections respectively;

wherein, when the left and right side protection sections are each in the stored position of the left and right side protection sections respectively, the left and right side protection sections are each stored against the back protection section;

wherein, when the left side protection section is in the deployed position of the left side protection section, the left side protection section covers a portion the user's left side when the backpack is worn by the user; and wherein, when the right side protection section is in the deployed position of the right side protection section, the right side protection section covers a portion the user's right side when the backpack is worn by the user.

4. The bulletproof backpack of claim 3 comprising:

wherein, when the left side protection section is in the deployed position of the left side protection section, the left side protection section covers a back portion of the user's left shoulder when the backpack is worn by the user; and wherein, when the right side protection section is in the deployed position of the right side protection section, the right side protection section covers a back portion of the user's right shoulder when the backpack is worn by the user.

5. The bulletproof backpack of claim 4, comprising:

the left side protection section comprising a left side protection panel having the bulletproof material integrated therein, the left side protection panel movably connected to the back protection section and operable to move from a deployed position to a stored position of the left side protection panel; and the right side protection section comprising a right side protection panel having the bulletproof material integrated therein, the right side protection panel movably connected to the back protection section and operable to move from a deployed position to a stored position of the right side protection panel;

wherein, when the left side protection panel is in the deployed position of the left side protection panel, the left side protection panel extends horizontally leftward from the back protection section to cover the portion of the user's left side and the back portion of the user's left shoulder when the backpack is worn by the user; and wherein, when the right side protection panel is in the deployed position of the right side protection panel, the right side protection panel extends horizontally rightward from the back protection section to cover the portion of the user's right side and the back portion of the user's right shoulder when the backpack is worn by the user.

6. The bulletproof backpack of claim 1 comprising:

a pelvic protection section having the bulletproof material integrated therein, the pelvic protection section movably connected to the back protection section and operable to move from a stored position to a deployed position of the pelvic protection section;

wherein, when the pelvic protection section is in the stored position of the pelvic protection section, the pelvic protection section is stored against the back protection section; and wherein, when the pelvic protection section is in the deployed position of the pelvic protection section, the pelvic protection section covers a back portion of the user's pelvic region when the backpack is worn by the user.

7. The bulletproof backpack of claim 6, wherein the pelvic protection section comprises:

a pelvic protection panel having the bulletproof material integrated therein, the pelvic protection panel movably connected to the back protection section and operable to move from a stored position to a deployed position of the pelvic protection panel;

wherein, when the pelvic protection panel is in the deployed position of the pelvic protection panel, the pelvic protection panel extends downwards from the back protection section to cover the back portion of the user's pelvic region when the backpack is worn by the user.

8. The bulletproof backpack of claim 1 comprising:

the neck protection section comprising a neck protection panel having the bulletproof material integrated therein, the neck protection panel movable from a stored position to a deployed position of the neck protection panel, wherein when the neck protection panel is in the deployed position of the neck protection panel, the neck protection panel extends upwards from the back protection section to cover the back of the user's neck and the back portion of the user's head when the backpack is worn by the user;

a left side protection panel having the bulletproof material integrated therein, the left side protection panel movably connected to the back protection section and operable to move from a stored position to a deployed position of the left side protection panel, wherein when the left side protection panel is in the stored position of the left side protection panel, the left side protection panel is stored against the back protection section, and wherein when the left side protection panel is in the deployed position of the left side protection panel, the left side protection panel covers a portion of the user's left side and a back portion of the user's left shoulder when the backpack is worn by the user; and a right side protection panel having the bulletproof material integrated therein, the right side protection panel movably connected to the back protection section and operable to move from a stored position to a deployed position of the right side protection panel, wherein, when the right side protection panel is in the stored position of the right side protection panel, the right side protection panel is stored against the back protection section, and wherein, when the right side protection panel is in the deployed position of the right side protection panel, the right side protection panel covers a portion of the user's right side and a back portion of the user's right shoulder when the backpack is worn by the user.

9. The bulletproof backpack of claim 8 comprising:

a pelvic protection panel having the bulletproof material integrated therein, the pelvic protection panel movably connected to the back protection section and operable to move from a stored position to a deployed position of the pelvic protection panel;

wherein, when the pelvic protection panel is in the stored position of the pelvic protection panel, the pelvic protection panel is stored against the back protection section; and wherein, when the pelvic protection panel is in the deployed position of the pelvic protection panel, the pelvic protection panel extends downwards from the back protection section to cover a back portion of the user's pelvic region when the backpack is worn by the user.

10. A bulletproof backpack comprising:

a back protection section comprising:

a backpack portion, and a back protection panel disposed between the backpack portion and a user's upper back when the backpack is worn by the user, the back protection panel having bulletproof material integrated therein, the back protection panel adapted to cover a portion of the user's upper back when the backpack is worn by the user;

a neck protection panel having the bulletproof material integrated therein, the neck protection panel movably connected to the back protection section and operable to move from a stored position to a deployed position of the neck protection panel;

wherein, when the neck protection panel is in the stored position of the neck protection panel, the neck protection panel is stored against the back protection section; and wherein, when the neck protection panel is in the deployed position of the neck protection panel, the neck protection panel is connected solely to the back protection section and the neck protection panel extends upward from the back protection section to cover solely a back of the user's neck and a back portion of the user's head when the backpack is worn by the user;

wherein, the neck protection panel is operable to be secured in the deployed position of the neck protection panel without manually being held in the deployed position of the neck protection panel.

11. The bulletproof backpack of claim 10, comprising:

a left side protection panel having the bulletproof material integrated therein, the left side protection panel movably connected to the back protection section and operable to move from a stored position to a deployed position of the left side protection panel, wherein when the left side protection panel is in the stored position of the left side protection panel, the left side protection panel is stored against the back protection section, and wherein when the left side protection panel is in the deployed position of the left side protection panel, the left side protection panel covers a portion of the user's left side and a back portion of the user's left shoulder when the backpack is worn by the user; and a right side protection panel having the bulletproof material integrated therein, the right side protection panel movably connected to the back protection section and operable to move from a stored position to a deployed position of the right side protection panel, wherein, when the right side protection panel is in the stored position of the right side protection panel, the right side protection panel is stored against the back protection section, and wherein, when the right side protection panel is in the deployed position of the right side protection panel, the right side protection panel covers a portion of the user's right side and a back portion of the user's right shoulder when the backpack is worn by the user.

12. The bulletproof backpack of claim 11 comprising:

a pelvic protection panel having the bulletproof material integrated therein, the pelvic protection panel movably connected to the back protection section and operable to move from a stored position to a deployed position of the pelvic protection panel;

wherein, when the pelvic protection panel is in the stored position of the pelvic protection panel, the pelvic protection panel is stored against the back protection section; and wherein, when the pelvic protection panel is in the deployed position of the pelvic protection panel, the pelvic protection panel extends downwards from the back protection section to cover a back portion of the user's pelvic region when the backpack is worn by the user.

13. The bulletproof backpack of claim 10 comprising:

the neck protection panel being slidably connected to the back protection section.

14. The bulletproof backpack of claim 10 comprising:

the neck protection panel being pivotally connected to the back protection section; and a joint system operable to pivotally rotate the neck protection panel from the stored position to the deployed position of the neck protection panel.

* * * * *